US006492319B1

(12) United States Patent
Nassano et al.

(10) Patent No.: US 6,492,319 B1
(45) Date of Patent: Dec. 10, 2002

(54) HIGH DENSITY DETERGENT-MAKING PROCESS INVOLVING A MODERATE SPEED MIXER/DENSIFIER

(75) Inventors: David Robert Nassano, Cold Springs, KY (US); Adrian John Waynforth Angell, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/763,051

(22) PCT Filed: Aug. 17, 1999

(86) PCT No.: PCT/US99/18657

§ 371 (c)(1),
(2), (4) Date: Mar. 7, 2001

(87) PCT Pub. No.: WO00/11131

PCT Pub. Date: Mar. 2, 2000

Related U.S. Application Data

(60) Provisional application No. 60/097,323, filed on Aug. 20, 1998.

(51) Int. Cl.[7] ..... C11D 11/00

(52) U.S. Cl. ..... 510/444; 510/441; 264/117

(58) Field of Search ..... 510/444, 441, 510/276, 495; 264/117

(56) References Cited

U.S. PATENT DOCUMENTS 5,431,857 A * 7/1995 Capeci ..... 510/444
5,663,136 A * 9/1997 Van Dijk et al. ..... 510/444
5,703,037 A * 12/1997 Doumen et al. ..... 510/444
5,736,501 A * 4/1998 Yamashita et al. ..... 510/444
5,916,867 A * 6/1999 Aouad et al. ..... 510/444

FOREIGN PATENT DOCUMENTS

| | | |
|---|---|---|
| WO | WO 98/06816 | 2/1998 |
| WO | WO 98/11193 | 3/1998 |
| WO | WO 98/14551 | 4/1998 |
| WO | WO 98/14552 | 4/1998 |
| WO | WO 98/14553 | 4/1998 |
| WO | WO 98/14554 | 4/1998 |
| WO | WO 98/14555 | 4/1998 |
| WO | WO 98/14556 | 4/1998 |
| WO | WO 98/14557 | 4/1998 |
| WO | WO 98/14558 | 4/1998 |
| WO | WO 98/24876 | 6/1998 |

* cited by examiner

*Primary Examiner*—Lorna M. Douyon
(74) *Attorney, Agent, or Firm*—Brahm J. Corstanje; Kim William Zerby; Steven W. Miller

(57) ABSTRACT

A process for producing high density detergent compositions is provided. The process is a continuous process during which high density detergent agglomerates are produced by feeding a surfactant paste and dry starting detergent material into a moderate speed mixer/densifier having a centrally positioned rotating shaft and at least one high speed chopper. The surfactant paste is inputted at least one location along the length of the moderate speed mixer/densifier to achieve optimal build-up agglomeration. The proces produces a free flowing, high density detergent composition which can be commercially sold as a low dosage or "compact" detergent composition.

13 Claims, No Drawings

HIGH DENSITY DETERGENT-MAKING PROCESS INVOLVING A MODERATE SPEED MIXER/DENSIFIER

This application is a 371 of PCT/US99/18657 filed Aug. 17, 1999 which claims benefit of Provisional Application No. 60/097,323 filed Aug. 20, 1998.

FIELD OF THE INVENTION

The present invention generally relates to a process for producing high density detergent compositions having improved physical properties. More particularly, the invention is directed to a continuous process during which high density detergent agglomerates are produced by feeding a surfactant paste and dry starting detergent material directly into a cylindrically-shaped/moderate speed mixer/densifier having a centrally positioned rotating shaft and at least one high speed chopper or cutter. The process produces an improved free flowing, high density detergent composition with a narrow particle size distribution which can be commercially sold as a low dosage or "compact" detergent composition.

BACKGROUND OF THE INVENTION

Recently, there has been considerable interest within the detergent industry for laundry detergents which are "compact" and therefore, have low dosage volumes. To facilitate production of these so-called low dosage detergents, many attempts have been made to produce high bulk density detergents, for example with a density of 600 g/l or higher. The low dosage detergents are currently in high demand as they conserve resources and can be sold in small packages which are more convenient for consumers.

Generally, there are several types of processes by which detergent granules or powders can be prepared. One type of process involves spray-drying an aqueous detergent slurry in a spray-drying tower to produce highly porous spray dried particulate material. In another type of process, various detergent components are dry mixed after which they are combined together with a binder such as a nonionic or anionic surfactant. In both processes, the most important factors which govern the density of the resulting detergent granules are the density, porosity and surface area of the various starting materials and their respective chemical composition. These parameters, however, can only be varied within a limited range. Thus, a substantial bulk density increase can only be achieved by additional processing steps which lead to densification of the detergent granules.

There have been many attempts in the art for providing processes which increase the density of detergent material. Particular attention has been given to densification of spray-dried particulate material by post tower treatment. For example, one attempt involves a batch process in which spray-dried or granulated detergent powders containing sodium tripolyphosphate and sodium sulfate are densified and spheronized in a Marumerizer®. This apparatus comprises a substantially horizontal, roughened, rotatable table positioned within and at the base of a substantially vertical, smooth walled cylinder. This process, however, is essentially a batch process and is therefore less suitable for the large scale production of detergent powders. Other attempts have been made to provide a continuous processes for increasing the density of "post-tower" or spray dried particulate material.

All of the aforementioned processes are directed primarily to densifying or otherwise processing spray dried particulate material. Currently, the relative amounts and types of materials subjected to spray drying processes in the production of detergent granules has been limited. For example, it has been difficult to attain high levels of surfactant in the resulting detergent composition, a feature which facilitates production of low dosage detergents. Thus, it would be desirable to have a process by which detergent compositions can be produced without having the limitations imposed by conventional spray drying techniques. To that end, the art is also replete with disclosures of processes which entail agglomerating detergent compositions. For example, attempts have been made to agglomerate detergent builders by mixing zeolite and/or layered silicates in a mixer to form free flowing agglomerates.

However, in all of the aforementioned processes, continuous large-scale production has its difficulties, especially relative to obtaining acceptable product consistently and with minimal wear and tear on the manufacturing equipment. For instance, while certain mixer/densifiers work extremely well at the lab scale, their performance is not always reproducible in large-scale commercial continuous manufacturing facilities. One problem experienced with large-scale detergent manufacturing using the aforementioned processes involves detergent product that has a wide particle size range. This, in effect, produces a detergent product having some "undersized" or very "fine" particles and some very large or "oversized" particles which is not only unacceptable to the consumer, but leads to product performance inconsistencies. Specifically, a particular dose or scoop of detergent product used by the consumer may not have the targeted ingredient levels because a disproportionate amount of "fines" or "overs" is in the dose as a result of the settling of the fines to the bottom of the product box during storage and handling. This inevitably leads to undesirable cleaning performance, and at a minimum, inconsistencies including performance. One solution to this problem is simply to recycle the "fines" and grind the "overs" to the desired size, but this increases the manufacturing costs significantly.

Another problem that has arisen involves excessive vibration of the rotating shafts in commercial scale mixer/densifiers, especially in large moderate speed mixer/densifiers, which can have deleterious effects on the detergent composition produced as well as on the mixer/densifiers and other closely located manufacturing equipment. This problem can also lead to structural damage to the manufacturing building for which substantial expenditures may be required for repairs. The use of additional mechanical apparatus such as tuned dampers positioned on the shaft only add to the cost of manufacturing and can interfere its with operation in that the tuned damper apparatus inside the mixer provides a place for detergent to accumulate, thereby deleteriously affecting mixer operation. Thus, there remains a need for a means by which commercial scale moderate speed mixer/densifiers used to produce low dosage, high density detergent compositions can be operated continuously without significant mechanical vibration and damage resulting therefrom.

Accordingly, there remains a need in the art to have a process for continuously producing a high density detergent composition which has improved physical properties including a more narrow particle size distribution. There is also a need for such a process that involves a moderate speed mixer/densifier that experiences minimal mechanical vibration, and yet, produces a superior detergent composition. Also, there remains a need for such a process which is more efficient and economical to facilitate large-scale production of low dosage or compact detergents.

BACKGROUND ART

The following references are directed to densifying spray-died particulate material: Appel et al, U.S. Pat. No. 5,133,924 (Lever); Bortolotti et al, U.S. Pat. No. 5,160,657 (Lever); Johnson et al, British patent No. 1,517,713 (Unilever); and Curtis, European Patent Application 451,894. The following references are directed to producing detergents by agglomeration: Capeci et al, U.S. Pat. No. 5,366,652; Capeci et al, U.S. Pat. No. 5,486,303; Capeci et al, U.S. Pat. No. 5,489,392; Capeci et al, U.S. Pat. No. 5,516,448; Beerse et al, U.S. Pat. No. 5,108,646 (Procter & Gamble). Other relevant prior art includes: PCT Publication WO 98/14558; PCT Publication WO 98/14557; PCT Publication WO 98/14556; PCT Publication WO 98/14553; PCT Publication WO 98/14552; PCT Publication WO 98/14555; PCT Publication WO 98/1454; PCT Publication WO 98/1455 1; and PCT Publication WO 98/11193 and WO 98/24876.

SUMMARY OF THE INVENTION

The present invention meets the aforementioned needs in the art by providing a process which continuously produces a high density detergent composition via a process during which high density detergent agglomerates are produced by feeding a surfactant paste and dry starting detergent material into a cylindrically-shaped/moderate speed mixer/densifier having a centrally positioned rotating shaft and at least one high speed chopper. In the process, surfactant paste and other dry starting detergent materials are inputted directly into the moderate speed mixer/densifier to form detergent agglomerates which are then cooled and/or dried. Importantly, the surfactant paste is inputted along the length of the moderate speed mixer/densifier to ensure optimal build-up agglomeration. The resulting agglomerates from the process are free flowing, more uniform in size and shape, and higher in surfactant level and are ready for incorporation into a commercially viable low dosage or "compact" detergent product.

As used herein, the term "agglomerates" refers to particles formed by build-up agglomeration of starting detergent ingredients typically having a smaller mean particle size than the formed agglomerates. All percentages and ratios used herein are expressed as percentages by weight (anhydrous basis) unless otherwise indicated. All documents are incorporated herein by reference. All viscosities referenced herein are measured at 70° C. (±5° C.) and at shear rates of about 10 to 100 $sec^{-1}$.

In accordance with one aspect of the invention, a process for preparing a crisp, free flowing, high density detergent composition is provided. The process comprises the steps of: (a) continuously adding a detergent surfactant paste and dry starting detergent material into a moderate speed mixer/densifier to form detergent agglomerates, wherein the moderate speed mixer/densifier includes a centrally rotating shaft and at least one high speed chopper located on the inside wall along the longitudinal length of said moderate speed mixer/densifier, wherein said surfactant paste is inputted along said longitudinal length of said moderate speed mixer/densifier; and (b) drying or cooling the detergent agglomerates so as to form the detergent composition. In another aspect of the invention, an acid precursor to a detergent surfactant is used in place of the surfactant paste to provide the detergent composition in agglomerate form.

In yet another aspect of the invention, another process for continuously preparing a detergent composition is provided. This process comprises the steps of: (a) continuously adding dry starting detergent material into a mixer to mixed dry detergent material; (b) inputting mixed dry detergent material and a detergent surfactant paste into a moderate speed mixer/densifier to form detergent agglomerates, wherein moderate speed mixer/densifier includes a centrally rotating shaft and at least one high speed chopper located on the inside wall along the longitudinal length of moderate speed mixer/densifier, wherein surfactant paste is inputted along longitudinal length of moderate speed mixer/densifier so as to mix with mixed dry detergent material after mixed dry detergent material enters moderate speed mixer/densifier; and (c) drying or cooling the detergent agglomerates so as to form the detergent composition.

Accordingly, it is an advantage of the invention to provide a process for continuously producing a high density detergent composition using a moderate speed mixer/densifier which experiences less vibration and produces a composition having a more narrow particle size distribution. Also, it is an advantage of the invention to provide such a process which is more efficient and economical to facilitate large-scale production of low dosage or compact detergents. These and other objects, features and attendant advantages of the present invention will become apparent to those skilled in the art from a reading of the following detailed description of the preferred embodiments and the appended claims.

DETAILED DESCRIPTION OF THE PREFERRED EMBODIMENT

Process

The present process can be used in the production of low dosage, high density detergent compositions containing agglomerates produced directly from dry starting detergent ingredients and a surfactant paste or precursor thereof. It has been surprisingly found that by using a single moderate speed mixer/densifier, a superior detergent composition in the form of agglomerates can be produced. The resulting detergent agglomerates have a tighter or more narrow particle size distribution which leads to the need for less recycling of undersized agglomerates back through the mixer/densifier and/or the need to grind oversized detergent agglomerates. Additionally, by inputting the surfactant paste or precursor thereof directly into the moderate speed mixer/densifier along its longitudinal length, sufficient mixing for rapid build-up agglomeration occurs. The resulting detergent agglomerates are also more spherical in appearance which is aesthetically desirable for modern day compact detergent products. Further, the process only requires one moderate speed mixer/densifier to produce the final detergent composition which is more economical than previous multi-step mixer processes.

In the first step of the process, the invention entails continuously mixing into a moderate speed mixer/densifier at least two streams of starting detergent ingredients including a surfactant paste stream and a dry starting detergent material stream. The surfactant paste added to the moderate speed mixer/densifier is in aqueous paste form and is added in amounts of from about 25% to about 65%, preferably from about 35% to about 55% and, most preferably from about 38% to about 44%, by weight of the total input stream to the mixer/densifier. Preferably, the dry starting detergent material comprises from about 20% to about 50%, preferably from about 25% to about 45%, and most preferably from about 30% to about 40%, of an aluminosilicate or zeolite builder, and from about 10% to about 40%, preferably from about 15% to about 30%, and most preferably from about 15% to about 25%, by weight of a sodium carbonate. The dry starting detergent material preferably is not a spray-dried particulate material, and does not contain a detergent surfactant.

While not intending to be bound by theory, it is believed that by inputting surfactant paste along the longitudinal length of a cylindrically-shaped moderate speed mixer/densifier having a centrally rotating shaft to which one or more of a variety of agglomeration tools are attached and at least one high speed chopper located on the inside wall of the mixer/densifier, optimal build-up agglomeration results. In preferred modes of the process, several high speed choppers are used in the moderate speed mixer/densifier, for example, at least two, preferably at least four, and most preferably at least six high speed choppers are used. Certain moderate speed mixer/densifiers can be equipped with as many as twelve high speed choppers to improve build-up agglomeration. Also, various multi-blade configurations can be used on the high speed choppers to optimize their effectiveness. The tip speed of any one of these choppers is preferably from about 1 m/s to about 60 m/s, more preferably from about 10 m/s to about 45 m/s, and most preferably from about 20 m/s to about 30 m/s. As those skilled in the art will appreciate, the tip speed can be adjusted with a variable speed drive apparatus connected to the high speed choppers. The rotational speed of any one of these choppers is preferably from about 200 rpm to about 5000 rpm, more preferably from about 1500 rpm to about 4500 rpm, and most preferably from about 3000 rpm to about 4000 rpm.

By inputting the surfactant paste near, preferably within 25 cm or less from the high speed choppers, it has been found that even more optimal build-up agglomeration occurs. Most optimal results are achieved by ensuring that at least 80% of the surfactant paste is added into the face of, underneath, or from within the high speed choppers. The resulting detergent agglomerates have the previously mentioned characteristics of a more narrow particle size distribution, more spherical-shaped agglomerates, and even have the ability to contain higher levels of surfactant. The higher level of surfactant in the detergent agglomerates is extremely beneficial as it allows for additional detergent ingredients to be added to the composition without sacrificing density or the degree of compactness of the detergent product.

Previous agglomeration processes which employ a high speed mixer for mixing the surfactant or precursor thereof and dry detergent material prior to the moderate speed mixer/densifier typically do not provide the desired narrow particle size distribution. In fact, such processes produce a substantial amount of undersized or fine particles which are recycled back through the process. It is not uncommon for 50% by weight of the agglomerates produced in such prior processes to require recycling and/or grinding to provide the desired mean particle size. In that regard, the present process dramatically reduces the amount of undersized and oversized detergent agglomerates produced which renders the process more efficient, economical and flexible. The particle size distribution is also more narrow. Specifically, the mean particle size of the agglomerates is preferably from about 150 microns to about 2000 microns, more preferably from about 250 microns to about 1000 microns, and most preferably from about 300 microns to about 500 microns.

Preferably, the surfactant paste and the dry starting detergent material are continuously added to the moderate speed mixer/densifier in weight ratio ranges described herein so as to ensure production of the desired free flowing, crisp, high density detergent composition. Preferably, the weight ratio of the surfactant paste to the dry starting detergent material is from about 1:10 to about 10:1, more preferably from about 1:4 to about 4:1 and, most preferably from about 2:1 to about 2:3.

The moderate speed mixer/densifier used in the present process includes liquid distribution and agglomeration tools so that both techniques can be carried forth simultaneously. As described, the liquid or paste distribution is accomplished with the use of at least one high speed chopper positioned on the inside wall along the length of the moderate speed mixer/densifier. For purposes of ensuring effective liquid or surfactant paste distribution and adequate build-up agglomeration, the high speed chopper preferably has a tip speed as mentioned above. To further facilitate build-up agglomeration, the moderate speed mixer/densifier is equipped with ploughs and/or other tools to ensure effective build-up agglomeration in the process. It is preferable to have the moderate speed mixer/densifier to be, for example, a Lödige KM (Ploughshare) mixer, Drais® K-T 160 mixer or similar brand mixer. The mean residence time in the moderate speed mixer/densifier is typically from about 0.1 minutes to about 20 minutes, most typically the residence time is about 0.5 minutes to about 10 minutes, wherein the mean residence time is conveniently and accurately measured by measuring the steady-state weight of the mixer/densifier (Kg) and dividing by the throughput (Kg/hr) of the mixer.

The process also exhibits reduced mechanical vibration in the moderate speed mixer/densifier. While not intending to be bound by theory, it is believed that the detergent surfactant paste input along the length of the moderate speed mixer/densifier, through for example, an input tube or nozzle, leads to a reduction of detergent material build-up on the inside wall of the moderate speed mixer/densifier. The detergent material "wall" that typically forms in prior art processes frequently causes a weight imbalance during mixer operation leading to undesirable mechanical vibration, especially of the centrally rotating shaft in the moderate speed mixer/densifier. By using the instant process, the preferred peak vibration range for the shaft is from about −1.0 G to about 1.0 G, more preferably from about −0.5 G to about 0.5 G, and most preferably from about −0.25 G to about 0.25 G, in a frequency range of from about 10 Hz to about 20 Hz as measured at the mid-span length of the shaft. Such peak vibration ranges represent a dramatic improvement over peak vibrations typically experienced in commercial scale manufacturing facilities which can be on the order of ±3.5 G. The peak vibration is preferably measured using 90 second intervals. As those skilled in the art will appreciate, such peak vibration measurements are easily completed using a conventional accelerometer (available from PCB 308B ICP Company, Buffalo, N.Y.).

For example, during continuous operation of the process, the vibration of shaft is recorded using the accelerometer attached to a power supply (e.g., PCB 480E090 from ICP Company, and a battery operated digital tape recorder such as the Sony TCD-D3 DAT recorder). The recorder and power supply are mounted in a waterproof, shock proof enclosure (such as the Carlon CJ1085 Enclosure). The sensor is attached to the shaft by means of dental cement or other rigid adhesive and is positioned such that radial shaft vibration is measured. The vibration is recorded for at least 2 hours, preferably for 4 hours. Upon completion of the run, the tape recorder is removed from the enclosure and played back. The data is plotted in 90 second intervals on either a digital or analog plotting device (such as the Hewlett-Packard 3560A or 35670A analyzers). The peak and rms values of the vibration can be determined from a PC-based software program such as Excel or Matlab.

While not intending to be bound by theory, the negative peak vibrations associated with the moderate speed mixer/densifier are especially exacerbated when the so-called "detergent wall" is present on the inner surface of the moderate speed mixer/densifier. During the process, an optional detergent coating or wall of at least about a 1 mm can cover a portion of the inner wall surface of the moderate speed mixer/densifier. The portion of the inner wall covered by this coating having a minimum thickness of 1 mm can be substantial (up to 100% of the inner surface covered) or a mere 50% can be covered. The presence of this detergent coating provides an irregular surface contour against which the ploughs are contacted during rotation of the shaft of the moderate speed mixer/densifier. This irregular surface results in the shaft being subjected to irregular forces, thereby further enhancing the overall mechanical vibration. This process wherein the detergent surfactant paste is added directly to, and along the length of the moderate speed mixer/densifier, however, eliminates or minimizes this additional mechanical vibration.

The preferred density of the resulting detergent agglomerates exiting the moderate speed mixer/densifier is at least about 650 g/l, more preferably from about 700 g/l to about 900 g/l. The particle porosity of the resulting detergent agglomerates of the composition is preferably in a range from about 5% to about 20%, more preferably at about 10%. The detergent agglomerates can be dried in a fluid bed dryer or cooled in a fluid bed cooler or similar apparatus which are well known in the art. While the detergent agglomerates exiting the moderate speed mixer/densifier and fluid bed cooler or dryer are ready for packaging and sale as a low dosage, compact detergent product at this point, they can be subjected to one or more optional processing steps.

Optional Process Steps

Optionally, a mixer may be used to pre-mix the starting dry detergent materials. Any suitable mixer can be used for such purposes including but not limited to a Shugi Granulator or a Lödige CB 30 mixer. Another optional process step involves adding a coating agent to improve flowability and/or minimize over agglomeration of the detergent composition in one or more of the following locations of the instant process: (1) the coating agent can be added directly into the fluid bed cooler or fluid bed dryer if used; (2) the coating agent may be added between the fluid bed dryer and the fluid bed cooler if both are used; (3) the coating agent may be added between the fluid bed dryer or cooler and the moderate speed mixer/densifier; and/or (4) the coating agent may be added directly to the moderate speed mixer/densifier. It should be understood that the coating agent can be added in any one or a combination of locations mentioned herein. The coating agent is preferably added into the moderate speed mixer/densifier as well as into the fluid bed dryer.

The coating agent is preferably selected from the group consisting of aluminosilicates, silicates, carbonates and mixtures thereof. The coating agent not only enhances the free flowability of the resulting detergent composition which is desirable by consumers in that it permits easy scooping of detergent during use, but also serves to control agglomeration by preventing or minimizing over agglomeration, especially when added directly to the moderate speed mixer/densifier. As those skilled in the art are well aware, over agglomeration can lead to very undesirable flow properties and aesthetics of the final detergent product.

Optionally, the process can comprises the step of spraying an additional binder in the moderate speed mixer/densifier and/or in the fluid bed dryer or cooler. A binder is added for purposes of enhancing agglomeration by providing a "binding" or "sticking" agent for the detergent components. The binder is preferably selected from the group consisting of water, anionic surfactants, nonionic surfactants, polyethylene glycol, polyvinyl pyrrolidone polyacrylates, citric acid and mixtures thereof. Other suitable binder materials including those listed herein are described in Beerse et al, U.S. Pat. No. 5,108,646 (Procter & Gamble Co.), the disclosure of which is incorporated herein by reference.

Other optional steps contemplated by the present process include screening the oversized and undersized detergent agglomerates in a screening apparatus which can take a variety of forms including but not limited to conventional screens chosen for the desired particle size of the finished detergent product. Another optional step of the instant process entails finishing the resulting detergent agglomerates by a variety of processes including spraying and/or admixing other conventional detergent ingredients. For example, the finishing step encompasses spraying perfumes, brighteners and enzymes onto the finished agglomerates to provide a more complete detergent composition. Such techniques and ingredients are well known in the art.

Detergent Surfactant Paste

The detergent surfactant paste used in the process is preferably in the form of an aqueous viscous paste, other forms are also contemplated by the invention, such as the acid precursor of a surfactant paste. If an acid precursor is used, the dry detergent material will include a neutralizing agent such as sodium carbonate. The viscous surfactant paste used herein has a viscosity of from about 5,000 cps to about 100,000 cps, more preferably from about 10,000 cps to about 80,000 cps, and contains at least about 10% water, more preferably at least about 20% water. The viscosity is measured at 70° C. and at shear rates of about 10 to 100 $sec^{-1}$. Furthermore, the surfactant paste, if used, preferably comprises a detersive surfactant in the amounts specified previously and the balance water and other conventional detergent ingredients.

The surfactant itself, in the viscous surfactant paste, is preferably selected from anionic, nonionic, zwitterionic, ampholytic and cationic classes and compatible mixtures thereof. Detergent surfactants useful herein are described in U.S. Pat. No. 3,664,961, Norris, issued May 23, 1972, and in U.S. Pat. No. 3,919,678, Laughlin et al., issued Dec. 30, 1975, both of which are incorporated herein by reference. Useful cationic surfactants also include those described in U.S. Pat. No. 4,222,905, Cockrell, issued Sep. 16, 1980, and in U.S. Pat. No. 4,239,659, Murphy, issued Dec. 16, 1980, both of which are also incorporated herein by reference. Of the surfactants, anionics and nonionics are preferred and anionics are most preferred.

Nonlimiting examples of the preferred anionic surfactants useful in the surfactant paste include the conventional $C_{11}$–$C_{18}$ alkyl benzene sulfonates ("LAS"), primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3^-M^+)CH_3$ and $CH_3(CH_2)_y(CHOSO_3^-M^+)CH_2CH_3$ where x and (y+1) are integers of at least about 7, preferably at least about 9, and M is a water-solubilizing cation, especially sodium, unsaturated sulfates such as oleyl sulfate, and the $C_{10}$–$C_{18}$ alkyl alkoxy sulfites ("$AE_xS$"; especially EO 1–7 ethoxy sulfates).

Optionally, other exemplary surfactants useful in the paste of the invention include and $C_{10}$–$C_{18}$ alkyl alkoxy carboxylates (especially the EO 1–5 ethoxycarboxylates), the $C_{10-18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid anodes, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Mixtures of anionic and nonionic surfactants are especially useful. Other conventional useful surfactants are listed in standard texts.

Dry Detergent Material

The starting dry detergent material of the present process preferably comprises a detergent aluminosilicate builder which are referenced as aluminosilicate ion exchange materials and sodium carbonate. The aluminosilicate ion exchange materials used herein as a detergent builder preferably have both a high calcium ion exchange capacity and a high exchange rate. Without intending to be limited by theory, it is believed that such high calcium ion exchange rate and capacity are a function of several interrelated factors which derive from the method by which the aluminosilicate ion exchange material is produced. In that regard, the aluminosilicate ion exchange materials used herein are preferably produced in accordance with Corkill et al, U.S. Pat. No. 4,605,509 (Procter & Gamble), the disclosure of which is incorporated herein by reference.

Preferably, the aluminosilicate ion exchange material is in "sodium" form since the potassium and hydrogen forms of the instant aluminosilicate do not exhibit as high of an exchange rate and capacity as provided by the sodium form. Additionally, the aluminosilicate ion exchange material preferably is in over dried form so as to facilitate production of crisp detergent agglomerates as described herein. The aluminosilicate ion exchange materials used herein preferably have particle size diameters which optimize their effectiveness as detergent builders. The term "particle size diameter" as used herein represents the average particle size diameter of a given aluminosilicate ion exchange material as determined by conventional analytical techniques, such as microscopic determination and scanning electron microscope (SEM). The preferred particle size diameter of the aluminosilicate is from about 0.1 micron to about 10 microns, more preferably from about 0.5 microns to about 9 microns. Most preferably, the particle size diameter is from about 1 microns to about 8 microns.

Preferably, the aluminosilicate ion exchange material has the formula $$Na_z[(AlO_2)_z.(SiO_2)_y]xH_2O$$

wherein z and y are integers of at least 6, the molar ratio of z to y is from about 1 to about 5 and x is from about 10 to about 264. More preferably, the aluminosilicate has the formula $$Na_{12}[(AlO_2)_{12}.(SiO_2)_{12}]xH_2O$$

wherein x is from about 20 to about 30, preferably about 27. These preferred aluminosilicates are available commercially, for example under designations Zeolite A, Zeolite B and Zeolite X. Alternatively, naturally-occurring or synthetically derived aluminosilicate ion exchange materials suitable for use herein can be made as described in Krummel et al, U.S. Pat. No. 3,985,669, the disclosure of which is incorporated herein by reference.

The aluminosilicates used herein are further characterized by their ion exchange capacity which is at least about 200 mg equivalent of $CaCO_3$ hardness/gram, calculated on an anhydrous basis, and which is preferably in a range from about 300 to 352 mg equivalent of $CaCO_3$ hardness/gram. Additionally, the instant aluminosilicate ion exchange materials are still further characterized by their calcium ion exchange rate which is at least about 2 grains $Ca^{++}$/gallon/minute/-gram/gallon, and more preferably in a range from about 2 grains $Ca^{++}$/gallon/minute/-gram/gallon to about 6 grains $Ca^{++}$/gallon/minute/-gram/gallon.

Adjunct Detergent Ingredients

The starting dry detergent material in the present process can include additional detergent ingredients and/or, any number of additional ingredients can be incorporated in the detergent composition during subsequent steps of the present process. These adjunct ingredients include other detergency builders, bleaches, bleach activators, suds boosters or suds suppressers, anti-tarnish and anticorrosion agents, soil suspending agents, soil release agents, germicides, pH adjusting agents, non-builder alkalinity sources, chelating agents, smectite clays, enzymes, enzyme-stabilizing agents and perfume. See U.S. Pat. No. 3,936,537, issued Feb. 3, 1976 to Baskerville, Jr. et al., incorporated herein by reference.

In order to make the present invention more readily understood, reference is made to the following examples, which are intended to be illustrative only and not intended to be limiting in scope.

EXAMPLE

This Example illustrates the process of the invention which produces free flowing, crisp, high density detergent composition. Two feed streams of various detergent starting ingredients are continuously fed, at a rate of 1320 kg/hr, into a Lödige KM 600 moderate speed mixer/densifier, one of which comprises an aqueous surfactant paste and the other stream containing starting dry detergent material containing aluminosilicate and sodium carbonate. The Lödige KM 600 moderate speed mixer/densifier has four high speed choppers, each having a tip speed of 15 m/s and a rotational speed of 3800 rpm, positioned on the inside wall along the longitudinal length of the Lödige KM 600. The surfactant paste is a non-linear viscolelastic surfactant paste having a viscosity of 100,000 cps (at 70° C. and at a shear rate of 1 $sec^{-1}$) and is inputted at four locations within 25 cm of each high speed chopper. The dry detergent materials are added via an inlet at the top-front of the Lödige KM 600 moderate speed mixer/densifier. The resulting detergent agglomerates are then fed to a fluid bed dryer and then to a fluid bed cooler, the mean residence time being about 10 minutes and 15 minutes, respectively. A coating agent, aluminosilicate, is fed after the moderate speed mixer/densifier to control and prevent over agglomeration. The composition of the detergent agglomerates exiting the fluid bed cooler is set forth in Table I below:

TABLE I

| Component | % Weight of Total Feed |
|---|---|
| $C_{14-15}$ alkyl sulfate | 22.5 |
| $C_{12.3}$ linear alkylbenzene sulfonate | 2.5 |
| Aluminosilicate | 35.2 |
| Sodium carbonate | 21.0 |
| Polyethylene glycol (MW 4000) | 1.5 |
| Misc. (water, etc.) | 12.3 |
| | 100.0 |

Additional detergent ingredients including perfumes, enzymes, and other minors are sprayed onto the agglomerates described above in the finishing step to result in a finished detergent composition which is admixed with spray dried particulate material in a 60:40 weight ratio (agglomerates: spray dried particulate material). The relative proportions of the overall finished detergent composition produced by the process of instant process is presented in Table II below:

TABLE II

| Component | (% weight) |
|---|---|
| $C_{14-15}$ alkyl sulfate/$C_{12.3}$ linear alkylbenzene sulfonate | 16.3 |
| Neodol 23-9.5[1] | 1.8 |
| Polyacrylate (MW = 4500) | 3.2 |
| Polyethylene glycol (MW = 4000) | 1.7 |
| Sodium Sulfate | 5.7 |
| Aluminosilicate | 26.3 |
| Sodium carbonate | 33.1 |
| Protease enzyme | 0.4 |
| Amylase enzyme | 0.1 |
| Lipase enzyme | 0.2 |
| Cellulase enzyme | 0.1 |
| Minors (water, perfume, etc.) | 11.1 |
| | 100.0 |

The density of the resulting fully formulated detergent composition is 621 g/l, the mean particle size is 400 microns. The density of the agglomerates alone is 810 g/l and the mean particle size is 450 microns.

Having thus described the invention in detail, it will be clear to those skilled in the art that various changes may be made without departing from the scope of the invention and the invention is not to be considered limited to what is described in the specification.

What is claimed is:

1. A process for continuously preparing a detergent composition comprising the steps of:

(a) continuously adding a detergent surfactant paste and dry starting detergent material into a moderate speed mixer/densifier to form detergent agglomerates, wherein said moderate speed mixer/densifier includes a centrally rotating shaft and at least four high speed choppers located along the longitudinal length of said moderate speed mixer/densifier, wherein said surfactant paste is inputted at at least four locations on the inside wall along said longitudinal length of said moderate speed mixer/densifier, each of said locations being within about 25 cm of a chopper, so as to mix said paste with said dry detergent material after said dry detergent material enters said moderate speed mixer/densifier, and wherein said mixer/densifier is operated without tuned dampers; and (b) drying or cooling the detergent agglomerates so as to form the detergent composition.

2. A process of claim 1 wherein the density of said detergent composition is at least 650 g/l.

3. A process of claim 1 wherein the mean particle size of said detergent agglomerates is from 150 microns to 2000 microns.

4. The process of claim 1 wherein the mean particle size of said detergent agglomerates is from about 250 microns to about 100 microns.

5. A process of claim 1 wherein the peak vibration of said shaft is from −1.0 G to 1.0 G in a frequency range of from 10 Hz to 20 Hz at the mid-span length of said shaft.

6. The process of claim 1 further comprising the step of adding a coating agent selected from the group consisting of aluminosilicates, carbonates, silicates and mixtures thereof into said moderate speed mixer/densifier.

7. The process of claim 1 wherein the mean residence time of said detergent agglomerates in said moderate speed mixer/densifier is in range from about 0.1 minutes to about 20 minutes.

8. The process of claim 1 wherein said four high speed choppers have a tip speed of from about 1 m/s to about 60 m/s.

9. The process of claim 1 wherein said dry detergent material is selected from the group consisting of carbonates, aluminosilicates and mixtures thereof.

10. The process of claim 1 wherein said surfactant paste has a viscosity of from about 1000 cps to about 100,000 cps.

11. A process for continuously preparing a detergent composition comprising the steps of: continuously adding an acid precursor of a detergent surfactant and dry starting detergent material into a moderate speed mixer/densifier to form detergent agglomerates, wherein said moderate speed mixer/densifier includes a centrally rotating shaft and at least four high speed choppers located on the inside wall along the longitudinal length of said moderate speed mixer/densifier, wherein said surfactant precursor is inputted at at least four locations along said longitudinal length of said moderate speed mixer/densifier, each of said locations being within about 25 cm of a chopper, so as to mix said precursor with said dry detergent material after said dry detergent material enters said moderate speed mixer/densifier, and wherein said mixer/densifier is operated without tuned dampers; and (b) drying or cooling the detergent agglomerates so as to form the detergent composition.

12. A process for continuously preparing a detergent composition comprising the steps of: continuously adding dry starting detergent material into a mixer to form mixed dry detergent material; inputting said mixed dry detergent material and a detergent surfactant paste into a moderate speed mixer/densifier to form detergent agglomerates, wherein said moderate speed mixer/densifier includes a centrally rotating shaft and at least four high speed choppers located on the inside wall along the longitudinal length of said moderate speed mixer/densifier, wherein said surfactant paste is inputted at at least four locations along said longitudinal length of said moderate speed mixer/densifier, each of said locations being within about 25 cm of a chopper, so as to mix said paste with said mixed dry detergent material after said mixed dry detergent material enters said moderate speed mixer/densifier, wherein said mixer/densifier is operated without tuned dampers; and (c) drying or cooling the detergent agglomerates so as to form the detergent composition.

13. The process of claim 12 wherein said four high speed choppers have a tip speed of from about 1 m/s to about 60 m/s.

* * * * *